US005816515A

United States Patent [19]

Krüger et al.

[11] Patent Number: 5,816,515

[45] Date of Patent: Oct. 6, 1998

[54] APPARATUS FOR MOVING A YARN PROCESSING DEVICE

[75] Inventors: Andreas Krüger, Mönchengladbach; Franz-Josef Flamm, Stolberg; Jochen Cüppers, Mönchengladbach; Joachim Stiller, Wegberg; Reinhard Marquardt, Nettetal, all of Germany

[73] Assignee: W. Schlafhorst AG & Co., Monchen-Gladbach, Germany

[21] Appl. No.: 681,325

[22] Filed: Jul. 22, 1996

[30] Foreign Application Priority Data

Jul. 22, 1995 [DE] Germany ..... 195 26 901.2
Aug. 3, 1995 [DE] Germany ..... 195 28 462.3

[51] Int. Cl.[6] ..... B65H 59/22; F16H 25/08; B05C 11/00

[52] U.S. Cl. ..... 242/150 M; 74/22 A; 118/78; 242/150 R; 242/18 R

[58] Field of Search ..... 242/158.2, 150 R, 242/149, 36, 150 M, 18 R; 74/22 A; 401/32, 33; 118/78

[56] References Cited

U.S. PATENT DOCUMENTS 2,554,493 5/1951 Heizer ..... 242/150
4,373,686 2/1983 Milli ..... 242/158.2
4,548,369 10/1985 Bossart ..... 242/150 R
4,725,015 2/1988 Zitzen ..... 242/150 R
5,294,071 3/1994 Hartel et al. .

FOREIGN PATENT DOCUMENTS 41 30 301 A1 3/1993 Germany .
42 26 265 A1 2/1994 Germany .
239932 3/1946 Switzerland .

*Primary Examiner*—Michael Mansen
*Attorney, Agent, or Firm*—Kennedy Covington Lobdell & Hickman, LLP

[57] ABSTRACT

In connection with a device for retracting and advancing a thread processing element in relation to a threadline it is provided that the retracting and renewed advancing is caused solely by switching on a drive motor in a direction opposite its normal operational direction of rotation. For this purpose a drive member, which is maintained fixed against relative rotation in this direction of rotation, and another drive member which can be rotated in this direction of rotation in relation to the first by way of a drive motor, are provided, which change a rotating movement into an axial movement.

23 Claims, 6 Drawing Sheets

110
111
112
113
114
115
116
117
118
119
120
121
122
123
124
125
126
127
128
129
130
131
134
135
136
137
138
139
140
141
142
143
144
145
146
147
148
149
150
151
152
153
154
155
156
157
158

APPARATUS FOR MOVING A YARN PROCESSING DEVICE

FIELD OF THE INVENTION

The present invention relates generally to an apparatus for positioning a yarn processing device in a textile machine, and more specifically to an apparatus for moving a yarn processing device in relation to a yarn travel path of a textile machine with a drive assembly connecting the yarn processing device with a drive motor.

BACKGROUND OF THE INVENTION

Yarn tensioners and/or waxing devices for acting on the yarn or treating the yarn are commonly employed in textile machines, in particular in automatic winding devices. Upon the occurrence of a yarn error, such as a yarn break or defect, the error must be removed and such yarn tensioners or waxing devices must be opened during the subsequent provision of a yarn connection, so that a face yarn and a bottom yarn can be securely inserted into the yarn travel path. With known winding devices the cleaning up of yarn errors, the provision of the yarn connection and the opening and closing of yarn tensioners and waxing devices take place automatically. For example, for opening the yarn tensioner it is necessary to pull one of the tensioning disks back from the other oppositely located tensioning disk and, subsequently, to push it forward again. For opening a waxing device, the waxing device is retracted out of the yarn travel path and subsequently advanced again into the yarn travel path. The movements required for this are often picked up from the drive mechanism of the winding apparatus by means of cam plates, reversing levers and rod arrangements.

In connection with such a yarn tensioner, such as is known from German Patent Publication DE 41 30 301 A1, one drive is sufficient for driving both tensioning disks without a central shaft being present. The oppositely located, ring-shaped permanent magnets located on both tensioning disks automatically align themselves in such a way that unlike magnetic poles are located opposite each other, thereby transferring a torque from the directly driven tensioning disk to the other tensioning disk which in this way is indirectly driven. The directly driven tensioning disk with the permanent magnets and the holder for the permanent magnets aligned with the other tensioning disk are fixed in the axial direction in such a way that the magnetic attractive forces of the unlike poles of the permanent magnets produce a transmission of the rotary motion of the directly driven disk to the indirectly driven disk, and cause rotary motion independently of the yarn-braking forces with which the two tensioning disks are pressed against each other. Thus the yarn-braking force with which the two tensioning disks are pressed against each other is exclusively determined by the mechanism generating the yarn-braking force, and is not affected by the transmission of rotary motion.

It is useful for inserting a yarn to open the yarn tensioner, i.e., to move the two tensioning disks apart in such a way that a gap is created between them in which the yarn can be inserted. German Patent Publication DE 41 30 301 A1 does not disclose how such an opening can be performed. There are two options for this in connection with the known construction, namely providing an additional mechanical device by means of which the tensioning disks can be moved apart or—in case the load-applying mechanism is embodied as a magnetic plunger—controlling this plunger electrically in such a way that it retracts the associated tensioning disk.

OBJECT AND SUMMARY OF THE INVENTION

It is the object of the invention to provide a device of the type mentioned at the outset, which can be manufactured at low cost, is simple to control and can be flexibly set in respect to the opening and closing times.

This object is attained in that the present invention comprises two drive members associated with a drive motor which has a forward and reverse direction of rotation, the two drive members being arranged to rotate in respect to each other when the drive motor rotates in its reverse direction, with axial movement of one of the drive members being effected from the drive members' relative rotation, and the axial movement of one of the drive members being transferred to the yarn processing device In accordance with another aspect of the present invention, the invention comprises a drive assembly including a drive motor having a forward and reverse direction of rotation and a drive arrangement for actuating movement of a yarn processing device, the arrangement including first and second drive members. When the drive motor rotates in its reverse direction, the first drive member is caused to rotate with the drive motor, but the second drive member is fixed against rotation with the drive motor in the reverse direction. Axial movement of one of the first and second drive members is effected by their relative rotation when the drive motor turns in the reverse direction, and the axial movement of one of the drive members is transferred to the yarn processing device.

The two drive members may be supported on each other in the axial direction by support surfaces which translate the rotation of the drive members relative to each other into an axial movement, which is then transferred to the yarn processing device.

The drive motor is used for movement of the yarn processing device, which movement consists of, for example, retraction and advancement of the yarn processing device with respect to a yarn travel path. For technological reasons the drive motor has a preset direction of forward rotation for normal operation, which can be reversed in a simple manner for retracting the yarn processing device. Advancement of the yarn processing device takes place when the drive motor is again switched into its preset forward direction for normal operation. With this embodiment it is possible to change the retraction and advancement or the opening or closing movement of a unit in accordance with technical requirements by changing the switching times of the drive motor, wherein only a change in the software is required. No mechanical components need to be replaced.

Helical cam surfaces are provided as the support means in an embodiment of the invention. Such cam surfaces can be easily produced and result in dependable functioning.

It is provided in a further embodiment of the invention that a load is applied to the two elements in the axial direction toward each other by means of a resilient spring member. In connection with the drive motor being driven in the forward direction of operation, the spring member assures that the two drive members take up their operating position again, i.e., that the yarn processing device is again advanced into the yarn travel path.

In connection with a yarn tensioning device the object of the invention is attained in that an arrangement for preventing the rotation of the indirectly driveable tensioning disk is provided, that the directly driveable tensioning disk can be rotated in relation to the indirectly driveable tensioning disk by the angular amount of the angular spacing of the permanent magnets arranged in a ring shape, and that at least one of the two tensioning disks together with the associated permanent magnets is yieldingly supported in the direction of the repelling forces of the permanent magnets.

It is possible in accordance with the invention to utilize the already present magnetic forces without an elaborate control being required and without it being necessary to interfere with the load-applying mechanism for this purpose.

Further characteristics and advantages of the invention ensue from the subsequent description of the embodiments represented in the drawings and from the dependent claims.

DETAILED DESCRIPTION OF THE PREFERRED EMBODIMENT

Figure 1:
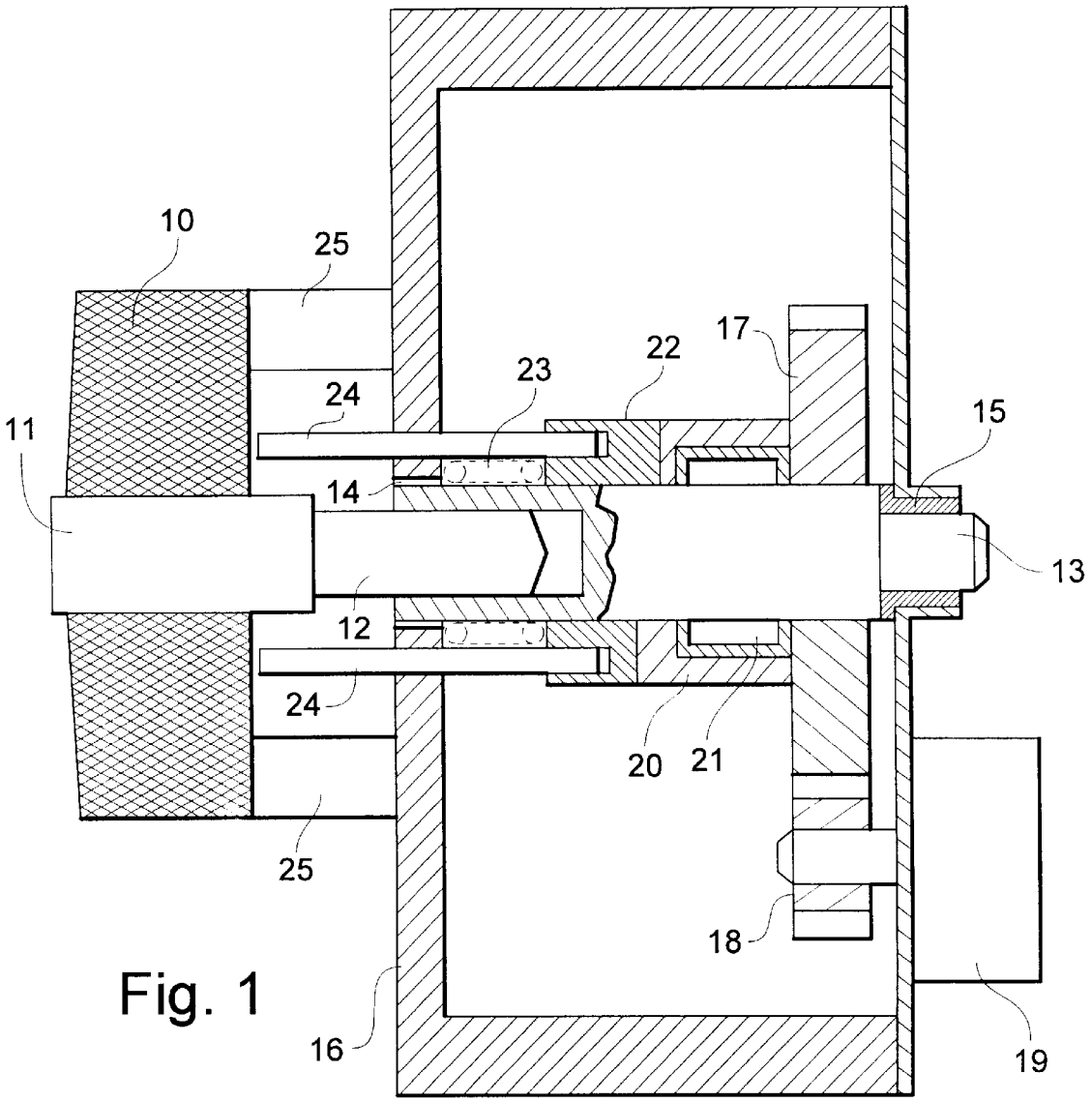
FIG. 1 is a sectional view through a waxing device incorporating an apparatus for extending and retracting a waxing roller according to the present invention.

The waxing device of FIG. 1 has a waxing roller (10) placed on a square mandrel (11) which has been inserted with its square shaft (12) into a drive shaft (13). The drive shaft (13) is seated in a housing (16) by means of sliding bearings (14, 15). A gear wheel (17) is seated, fixed against relative rotation, on the drive shaft (13) which is axially supported in the sliding bearing (15) and meshes with a pinion (18) of a drive motor (19), in particular a step motor. In normal operation, the drive motor (19) drives the drive shaft (13) and the waxing roller (10) with it in a predetermined forward direction of rotation which is set in such a way that the waxing roller (10) moves in the opposite direction in respect to a yarn, not shown, which runs along its inner front face. As used herein, "forward" is intended to signify, with respect to any particular component, the direction in which that component rotates when the drive motor rotates in its normal forward direction of operation, and "reverse" is intended to signify the opposing direction of rotation.

A first drive member (20) is seated on the drive shaft (13) by means of a free-wheeling device (21), which is designed in such a way that in the operational running direction of the drive motor (19) the drive shaft (13) does not engage the first drive member (20) to rotate it, but that it is coupled with and driven by the drive shaft (13) when the direction of rotation is reversed.

On the side facing away from the waxing roller (10), the first drive member (20) is supported in the axial direction on the gear wheel (17) fixed on the drive shaft (13). On the opposite side the first drive member (20) is supported on a second drive member (22), which is also disposed on the drive shaft (13) and is pressed against the first drive member (20) by means of a resilient compression spring (23) supported on the housing (16). As used herein, "axial" is intended to signify in the direction of or parallel to the direction of the axis of the component referenced.

The second drive member (22) is provided with a plurality of tappets (24) extending parallel with the drive shaft (13), which are guided in openings of the housing (16) and are located opposite the inner front face of the waxing roller (10). These tappets (24) secure the second drive member (20) against twisting. When the second drive member (22) is displaced in the axial direction of the drive shaft (13), the tappets (24) push the waxing roller (10) away from the housing (16) and thus also away from the yarn running along the inner front face of the waxing roller (10).

When in the process of making a yarn connection it is intended to pull the waxing roller (10) out of the yarn travel path in which it is held against stops (25) by means of a load-applying device, not shown in detail, the motor (19) is stopped and reversed in such a way that it performs a reverse turn over a predetermined angle of rotation. In this direction of rotation, which is opposite the normal forward direction of rotation, the first drive member (20) is taken along by the drive shaft (13), because in this direction the free-wheeling device (21) blocks and acts as a coupling. The first drive member (20) is turned in relation to the second drive member (22) in this way. Axial support means are provided between the two elements (20, 22) which cause a relative turning of the first and second drive members (20, 22) against each other to be translated into an axial movement which is then transferred to the waxing roller (10).

In order to translate the relative turning movement between the first and second drive members (20, 22) into a relative axial movement, the first drive member (20) is provided with a support face (26) embodied as a helical cam surface, on which the second drive member (22) is supported. The helically shaped cam surface (26) of the first drive member (20) and the oppositely located, cam-shaped support surface (27) of the second drive member (22) are shown in FIG. 2 while rolling off each other.

The waxing roller (10) remains lifted off the stops (25) by means of the extended tappets (24) until the yarn has been reinserted into the yarn travel path. Subsequently the yarn draw-off device is switched on again and the drive motor (19) is also switched on in its normal direction of rotation. In the process the first drive member (20) is taken along by the drive shaft (13) over the short angle of rotation, wherein this movement is aided by the effect of the spring (23). Afterwards the second drive member (22) and along with it its tappets (24) again take up the represented position. The waxing roller (10) is guided to follow this movement and is again placed on the yarn and the stops (25). Following this, the free-wheeling device (21), together with the cam surfaces (26, 27) and the compression spring, assures that the first drive member (20) is not taken along further in the direction of rotation.

Figure 2:
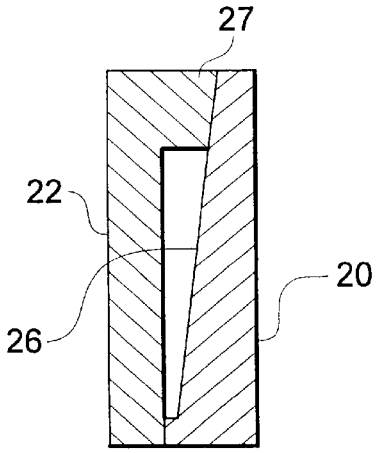
FIG. 2 is a detailed view showing two drive members of the apparatus of FIG. 1.
Figure 3:
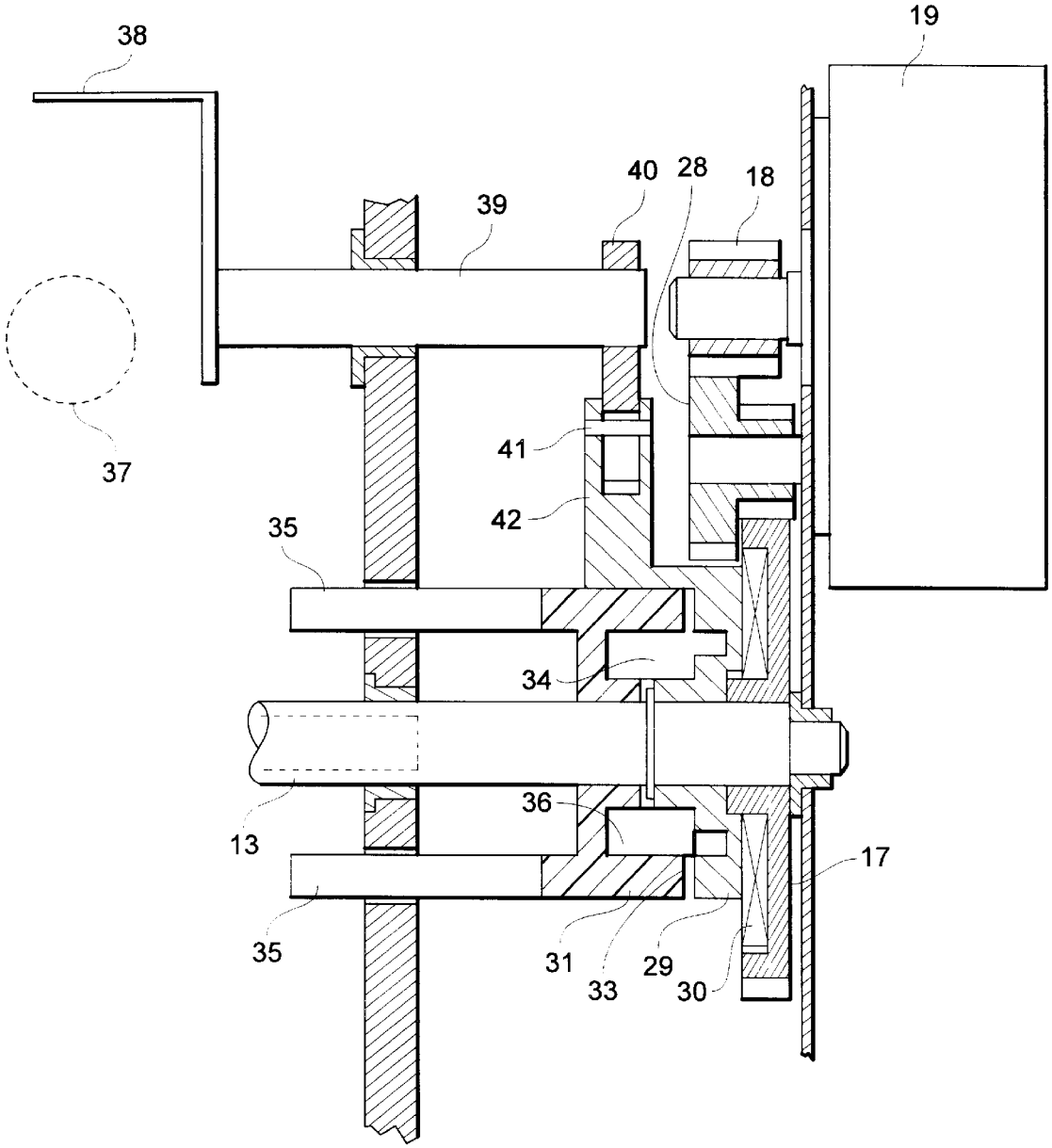
FIG. 3 is a sectional view through a variant of an apparatus for extending and retracting a waxing roller in accordance with the present invention, which is simultaneously used for opening and closing a closure flap of a suction nozzle.

In its basic principle the exemplary embodiment in accordance with FIG. 3 corresponds to the exemplary embodiment in accordance with FIGS. 1 and 2. Via a pinion (18) and with an intermediate wheel (28) interposed, a drive motor (19) drives a gear wheel (17), which is disposed, fixed against relative rotation, on a drive shaft (13) for a waxing roller (10). A first drive member (29) is located on the drive shaft (13) and is connected by means of a free-wheeling device (30) with the gear wheel (17). The free-wheeling device (30) is laid out in such a way that it couples the first drive member (29) and the gear wheel opposite the normal direction of rotation so that, after it has been switched on in reverse, the drive motor (19) takes along the first drive member (29) opposite the normal forward direction of rotation of the drive shaft (13).

A second drive member (31) disposed on the drive shaft (13) is associated with the first drive member (29) and has cam surfaces (33) which are located in the axial direction opposite helically shaped surfaces (34) of the first drive member (29). The second drive member (31) is provided with tappets (35) which extend through openings of a housing wall in such a way that the second drive member (31) is secure against twisting. If by means of appropriate switching the drive motor (19) is reversed over a predetermined angle of rotation opposite its normal direction of rotation, the first drive member (29) is also reversed via the gear wheel (17) and the free-wheeling device (30). The cam surfaces (33) of the second drive member (31) then slide on the cam surfaces (34) of the first drive member (29) in such a way that the second drive member (31) is displaced axially in relation to the first drive member (29) and thus also axially in relation to the drive shaft (13). This displacement movement is transferred to the waxing roller, not shown, in accordance with the explanations in connection with the embodiment of FIGS. 1 and 2.

A torsion draw spring (36) is disposed between the first and second drive members (29, 30), and generates a force pulling the second drive member (31) in the direction toward the first drive member (29). The force of the torsion draw spring (26) is increased during a relative turning of the first and second drive members (29, 31) in respect to each other.

When the drive motor (19) is again switched on in its normal direction of rotation, the gear wheel (17) takes the first drive member (29) along in the normal forward direction of rotation over the angle of rotation by which it had previously been deflected. The second drive member (31) then again moves—aided by the force of the torsion draw spring (36)—in the direction toward the first drive member (29).

In the exemplary embodiment of FIG. 3, a displacement drive for a further auxiliary device is derived from the drive of the waxing roller. It is known to dispose a suction nozzle (37) above the waxing device at the winding stations of an automatic winding device, which is shown in dashed lines in FIG. 3. Usually this suction nozzle (37) is closed by means of a closure flap (38) while a yarn connection is made after a yarn break, i.e., when the waxing roller has also been moved out of the yarn travel path. The closure flap (38) is disposed on a shaft (39) seated in the housing. This shaft (39) is driven and the closure flap (38) moved into the closing position when the drive motor (19) is reversed over a predetermined angle of rotation opposite the normal direction of rotation. A Maltese-cross segment (40) is provided for this on the shaft (39), whose slit guide is engaged by a bolt (41) disposed in a radial shoulder (42) of the first drive member (29). When the first drive member (29) is reversed for opening the waxing device, it takes along the Maltese-cross-shaped element (40) of the shaft (39) via the bolt (41), so that the closure flap (38) is brought into the closed position. The closure flap (38) is opened again when the first drive member (29) is returned into its operating position by switching on the drive motor (19) for driving the waxing roller.

Figure 4:
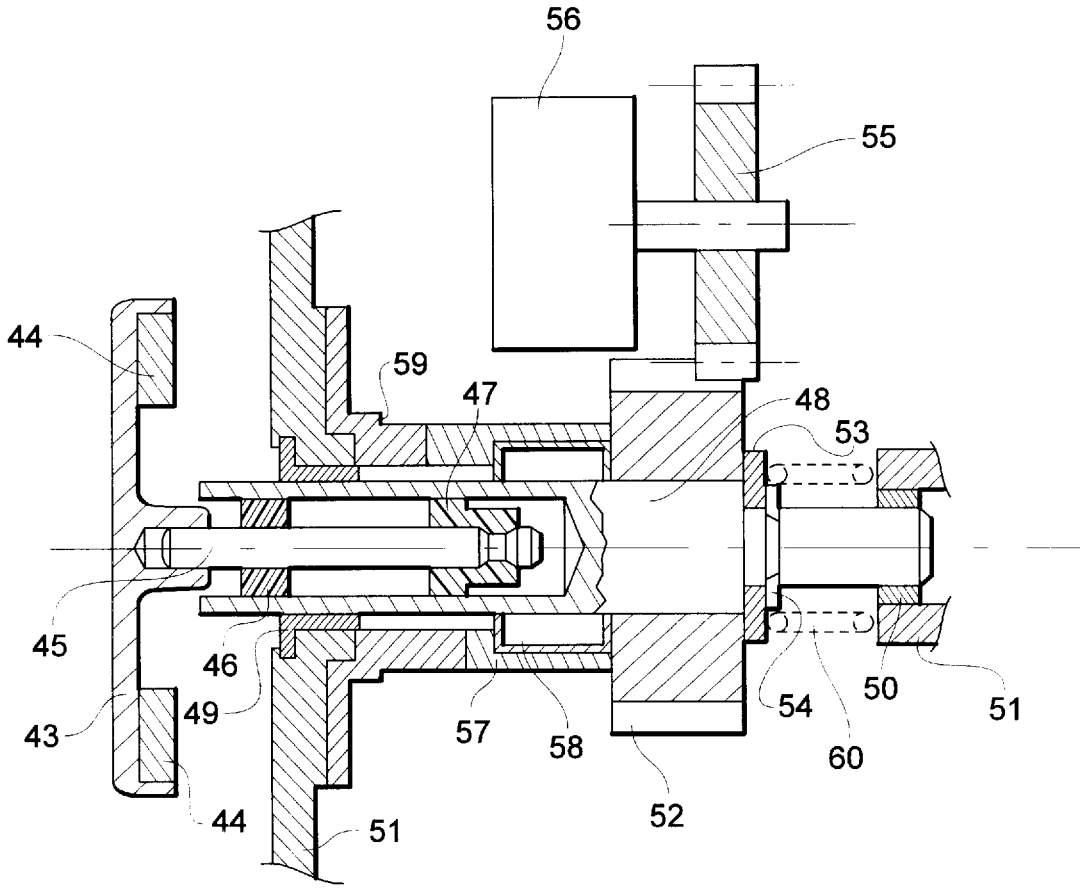
FIG. 4 is a sectional view through a drive unit of a yarn tensioning device equipped with a variant of an apparatus in accordance with the present invention for retracting and advancing a tensioning disk.

FIG. 4 shows an exemplary embodiment wherein the functioning principle explained by means of FIGS. 1 to 3 is employed with a drive unit for a yarn tensioner. This drive unit contains a tensioning disk (43) with a second tensioning disk, not shown, disposed coaxially opposite it. This second tensioning disk is pressed with a preset adjustable pressing force against the represented tensioning disk (43), for which purpose this non-represented second tensioning disk is equipped with a resilient load-applying device or a plunger. The non-represented second tensioning disk does not contain its own drive. Instead, it is also driven by the drive of the tensioning disk (43), for which purpose the tensioning disk (43) is equipped with permanent magnets (44), opposite which permanent magnets of opposite polarity of the non-represented second tensioning disk are located.

The tensioning disk (43) is connected, fixed against relative rotation, with a shaft stub (45) which is disposed by means of rubber-elastic coupling elements and fixed against relative rotation in an axial bore of a drive shaft (48). The drive shaft (48) is displaceably seated by means of sliding bearings (49, 50) in a housing (51).

A gear wheel (52) is disposed, fixed against relative rotation, on the drive shaft (48) and is fixed in the axial direction in the direction towards the tensioning disk (43) by means of a disk (53) and a retaining ring (54). A pinion (55) of a drive motor (56) engages the gear wheel (52). A first drive member (57) is seated on the drive shaft (48) by means of a free-wheeling device (58), which blocks opposite the normal forward direction of rotation, i.e., couples the first drive member (57) with the drive shaft (48) if the latter is turned in reverse opposite its normal direction of rotation by the drive motor (56). The first drive member (57) is supported in the axial direction against the gear wheel (52) and on the opposite side against a second drive member (59). The second drive member (59) is fixed on the housing (51) in the circumferential direction and in the axial direction, for example by means of screws. The first and second drive members (57, 59) are supported on each other by way of support means, which translate a relative rotating motion into an axial motion. For example, the first drive member (57) is provided with a helical cam surface and the second drive member (59) with a cam surface in accordance with FIG. 2. A compression spring (60) puts a load on the drive shaft (48) in such a way that the first and second drive members (57, 59) are pressed against each other. The compression spring (60) is disposed between the disk (53) and the housing (51) and is embodied as a torsion spring.

The normal operating position is represented in FIG. 4, in which the drive motor (56) drives the drive shaft (48) and with it the tensioning disk (43) in a predetermined forward direction of rotation by means of the pinion (55) of the gear wheel (52). During this motion in the operationally predetermined manner, the free-wheeling device (58) releases the first drive member (57) so that it does not rotate along with it and is instead kept stationary by the second drive member (59). If the drive motor (56) is stopped and subsequently reversed by a predetermined angular amount opposite its normal direction of rotation, the free-wheeling device (58) couples the first drive member (57) with the drive shaft (48) so that it turns in relation to the element (59) which is held fixed against relative rotation. The supporting cam surfaces between the first and second drive members (57, 59) then cause this relative rotary movement to be changed into an axial movement between the two drive members (57, 59). This axial movement is transmitted to the drive shaft (48), so that the drive shaft (48) together with the tensioning disk (43) is retracted out of the operational position.

If the drive motor (56) is again operated in its normal direction of rotation, the drive shaft (48) returns the first drive member (57) into the operating position. In spite of the free-wheeling device (58), the first drive member (57) is taken along over the corresponding angle of rotation because of the effect of the compression spring (60) until it reaches the operational position represented in FIG. 4.

Figure 5:
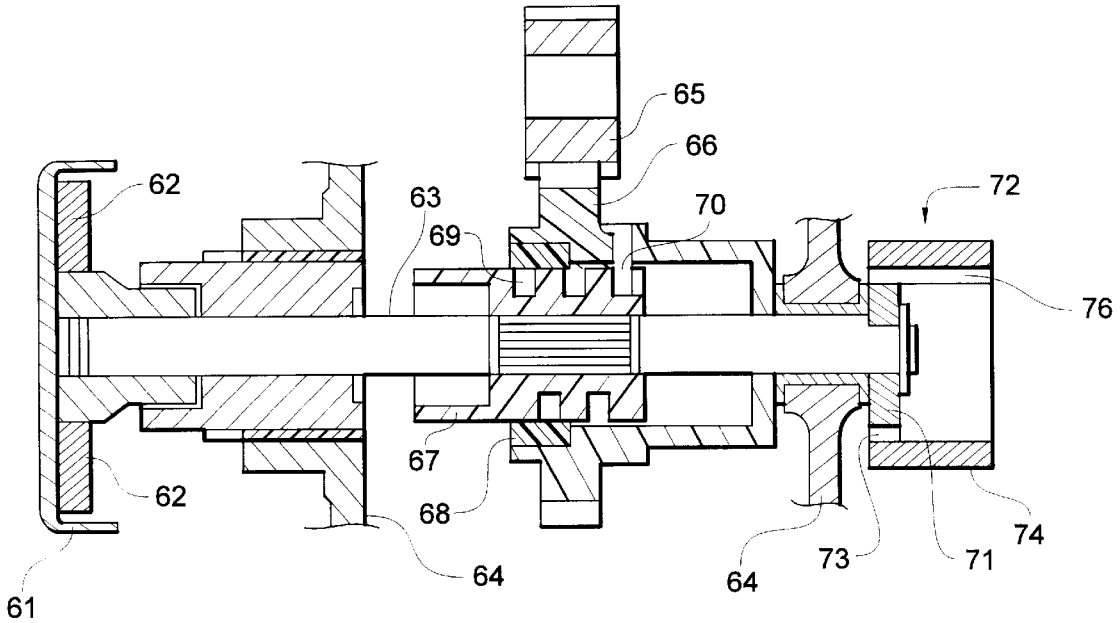
FIG. 5 is a sectional view through a drive unit of a yarn tensioning device with a further embodiment of an apparatus in accordance with the present invention wherein the tensioning disk does not rotate during the retraction and the advancement.
Figure 6:
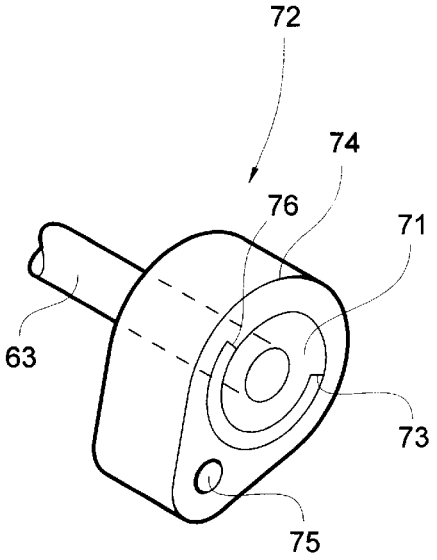
FIG. 6 is a perspective view of a detail of the embodiment of FIG. 5.

With the embodiment in accordance with FIGS. 5 and 6, the advantage is obtained that the yarn processing element, in the exemplary embodiment represented by a tensioning disk (61) of a yarn tensioning device, is retracted and again advanced without the yarn processing element rotating in the process.

The tensioning disk (61), which is provided with permanent magnets (62) on its back, is disposed fixed against relative rotation on a drive shaft (63) seated in a housing (64). The drive shaft (63) is driven by means of a pinion (65) of a drive motor, not shown, a step motor, by means of a simplified form of a screw drive. The pinion (65) meshes with a gear wheel drive member (66) embodied as a hollow wheel and seated on the drive shaft (63). A drive wheel drive member (67), which is connected, fixed against relative rotation, on the drive shaft (63), is seated by means of a sliding bearing (68) inside this gear wheel drive member (66). On its circumference the drive wheel drive member (67) is provided with a spiral-shaped groove (69), which is engaged by a pin (70) fixed in the gear wheel drive member (66).

The drive shaft (63) is axially displaceable in the bearings of the housing (64). The drive wheel drive member (67) is also displaceable inside the gear wheel drive member (66). The axial position of the drive shaft (63) in the direction towards a non-represented oppositely located tensioning disk is fixed by means of a disk (71) which is a part of a free-wheeling device (72). The disk (71) has a circumference in the form of a spiral outline which ends in a tooth-like protrusion (73). The disk (71) is disposed inside a rocker (74), which is seated on the housing (64), pivotable around a shaft (75) which is parallel with the shaft (63). The rocker (74) has an inner contour which is helical in a direction opposite the circumferential surface of the disk (71) and also terminates in a tooth-shaped shoulder (76). In one direction of rotation (opposite the clockwise direction in FIG. 6), the disk (71) can freely rotate inside the rocker (74). When the direction of rotation is reversed, the tooth-shaped shoulder (73) of the disk (71) runs up against the tooth-shaped shoulder (76) of the rocker, so that further rotation of the drive shaft (63) in this direction is blocked. If the gear wheel drive member (66) is further driven in this direction of rotation, which is opposite the normal direction of rotation, the pin (70) wanders in the spiral-shaped groove (69) of the non-rotating drive wheel drive member (67), so that by means of this the drive wheel drive member (67), together with the shaft (63) and the tensioning disk (61), is moved in the axial direction. If the direction of rotation of the drive motor and thus of the gear wheel drive member (66) is reversed again, the pin (70) initially runs in the spiral-shaped groove (69) back into its end position or stop position, so that then the drive wheel drive member (67) and, thus, the drive shaft (63) and the tensioning disk (61) are first pushed back in the axial direction into the operating position without rotating. To aid this axial displacement into the operating position it is possible to dispose a compression spring in a manner not shown between the front end face of the drive wheel drive member (67) and a radial wall of the gear wheel drive member (66). In this exemplary embodiment the elements, which rotate in relation to each other when the direction of rotation of the drive motor is reversed and in the course of this translate the rotating motion into an axial movement, are therefore the gear wheel drive member (66) and the drive wheel drive member (67), i.e., the elements of the drive mechanism which also transfer the driving force during operation.

Other gear connections or the like are also possible in order to translate a rotation of the two elements of the exemplary embodiments in accordance with FIGS. 1 to 6 into an axial movement. For example, it can be provided that one of the elements encloses the other element in a sleeve-like manner, wherein one of the elements is provided with a guide slot and the other element with a guide pin. In this case, too, a simplified screw drive is obtained, similar to FIGS. 5 and 6.

Figures 7A, 7B:
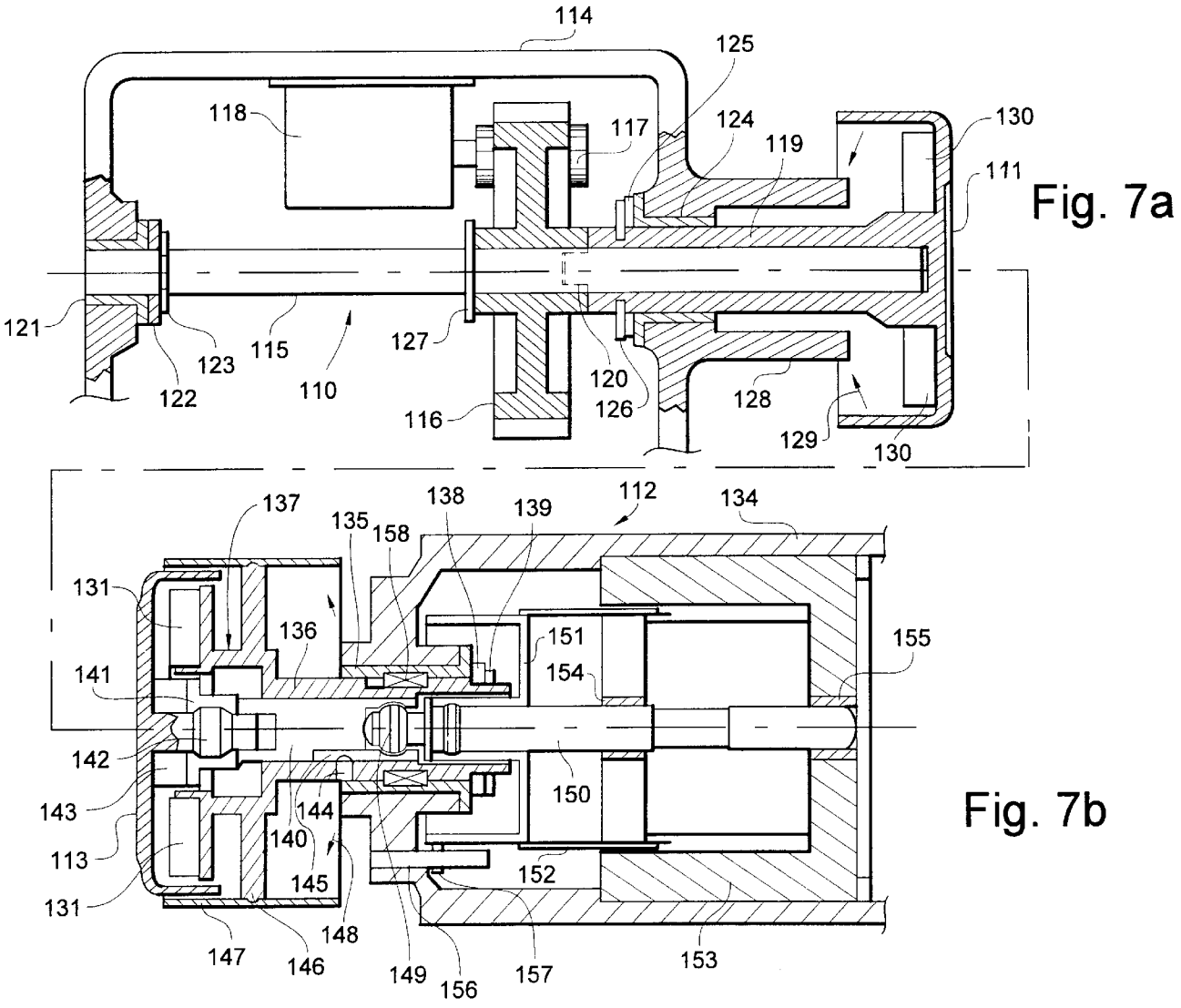
FIGS. 7*a* and 7*b* are sectional views through a yarn tensioner incorporating a variation of the present invention for extending and retracting a tensioning disk.

The yarn tensioner in accordance with FIGS. 7*a* and 7*b* has a drive unit (110) with a tensioning disk (111), and a tensioning unit (112) with a tensioning disk (113). The tensioning disks (111, 113) are disposed essentially coaxially in respect to each other, so that they clampingly receive a running yarn between them. The drive unit (110) contains a housing (114), in which a shaft (115) is seated. A gear wheel (116) is disposed, fixed against relative rotation, on the shaft (115), with which a pinion (117) of a drive motor (118), in particular a step motor, meshes. A sleeve (119) of the tensioning disk (111) is furthermore disposed on the shaft (115) and is coupled by means of coupling elements (120) with the gear wheel (116). On its end remote from the tensioning disk (111), the shaft (115) is seated by means of a bearing (121) in a bearing receptacle of the housing (114). The shaft (115) is fixed by means of a bearing disk (122) and a retaining ring (123) in this bearing (121) in the direction away from the tensioning disk (111). The sleeve (119) of the tensioning disk (111) is also seated by means of a bearing (124) in a bearing receptacle of the housing (114). It is fixed in the direction toward the tensioning disk (111) by means of a bearing disk (125) and a retaining ring (126). A further retaining ring (127) disposed on the shaft (115) secures the position of the gear wheel (116) in respect to the sleeve (119) of the tensioning disk (111). The tensioning disk (111) has an approximately cup-shaped form, wherein its rim is oriented away from the tensioning surface facing the tensioning disk (113). Sealing means (129) indicated by arrows are arranged between the rim of the tensioning disk (111) and a shoulder (128) of the housing (114).

On its side facing away from the tensioning surface, the tensioning disk (111) has permanent magnets (130) arranged in the shape of a ring, which are polarized in such a way that in the circumferential direction a north pole and a south pole alternatingly point to the tensioning side of the tensioning disk (111). The permanent magnets (130) are arranged in a predetermined annular pattern, for example spaced at angular distances of 90°.

The tensioning unit (112) has a housing (134) which contains a bearing bushing (135) in a bearing receptacle. A cylindrical shoulder (136) of a holder (137) is seated in this bearing bush (135), which holds permanent magnets (131) which are arranged corresponding to the annular pattern of the permanent magnets (130). The cylindrical shoulder (136) of the holder (137) is fixed in the direction toward the tensioning disk (113) by means of a bearing disk (138) and a retaining ring (139).

The cylindrical shoulder (136) of the holder (137) has an axial bore in which a spacer (140) is arranged. On its end facing the tensioning disk (113), the spacer (140) is provided with fingers (141) which envelop a bulge (142) of a pin of the tensioning disk (113). A spring element (143) is disposed between the back of the tensioning disk (113) and the ends of the fingers, which pulls the bulge (142) against stops on the fingers (141) and in this way fixes the tensioning disk (113) in respect to the spacer (140).

The spacer (140) is connected, fixed against relative rotation, with the tensioning disk (113). It is furthermore seated, fixed against relative rotation, in the shoulder (136), but is (within set limits) displaceable axially in respect to the shoulder (136). For this purpose the cylindrical shoulder is provided with one or several pins (144) which engage corresponding longitudinal grooves (145) of the spacer (140).

The holder (137) is provided with a circumferential bar (146) on which a protective cap (147) is disposed. The protective cap (147) encloses the rim, which faces away from the tensioning surface, of the cup-shaped tensioning disk and extends as far as the ring collar of the housing (134). Sealing elements (148), indicated by arrows, are disposed between the ring collar of the housing (134) and the protective cap (147).

The end of the spacer (140) facing away from the tensioning disk (113) is also equipped with fingers which extend with play around a bulge (149) of a push rod (150) which is arranged coaxially with the tensioning disk (113) and the spacer (140). In the axial direction the push rod (150) is supported in a point in the center of the spacer (140). The push rod (150) is furthermore interlockingly connected in the axial direction with a coil holder (151) which supports a plunger (152). The plunger (152) dips into a pot-shaped magnet (153), which is arranged in a housing (134). The push rod (150) is seated axially displaceable in bearings (154, 155) of the pot-shaped magnet (153).

In normal operation the permanent magnets (130, 131) align themselves in respect to each other in such a way that the unlike poles of the magnets (130, 131) lie opposite each other. A magnetic coupling is created by this between the directly driven tensioning disk (111) and the tensioning disk (113), which is indirectly driven via the permanent magnets (130, 131). Since the tensioning disk (111) is fixed in its position in respect to the tensioning disk (113), and, since the holder (137) of the permanent magnet (131) is also fixed in its position in respect to the tensioning disk (111), the attractive forces of the magnets (130, 131) do not become effective between the two tensioning disks (111, 113). Thus, the tensioning disk (113) is moved exclusively in the direction toward the tensioning disk (111) by means of the forces generated by the plunger (152) and the pot-shaped magnet (153), which are transferred via the push rod (150) and the spacer (140) to the tensioning disk (113), so that the plunger (152) and the pot-shaped magnet (153) alone determine the tensioning effect of the yarn tensioner. The plunger (152) and the pot-shaped magnet (153) are secure against rotating movements. For this purpose the housing (134) is provided with a notched pin (156), on which the coil holder (151) is guided with a shoulder (157) and is fixed against twisting in this way.

To open the yarn tensioner in accordance with FIGS. 7*a* and 7*b*, the tensioning disk (113) is moved away from the tensioning disk (111) in the direction toward its housing (134). This takes place by making use of the forces of the permanent magnets (130, 131). To this end the directly driven tensioning disk (111) with its permanent magnet is turned in relation to the tensioning disk (113) by an angular amount corresponding to the division of the permanent magnets (130, 131), so that thereafter the permanent magnets with like poles lie opposite each other and in this way generate magnetic repulsive forces. By means of these repulsive forces the permanent magnets (131), together with their holder (137), are displaced away from the tensioning disk (111) in the direction toward the housing (134) of the tensioning unit. After a brief idle path the pin (144) runs up against the end of the longitudinal groove (145) facing away from the tensioning disk (113) and via the spacer (140) carries the tensioning disk (113) along in the direction of the magnetic repulsive forces. These magnetic repulsive forces are laid out in such a way that they easily overcome the forces of the plunger (152), without it being necessary to trigger the plunger (152) for performing this opening movement. However, it can also be provided that during opening and holding of the tensioner in the opened position the plunger (152) is not provided with current.

To make the relative rotation between the tensioning disk (111) and the tensioning disk (113) possible, in the exemplary embodiment according to FIGS. 7*a* and 7*b* the holder (137) of the permanent magnets (131) is additionally seated in respect to the housing (134) or the bearing bush (135) in a free-wheeling device (158) which only permits a rotation of the holder (137) in the operational direction of rotation and blocks a rotation in the opposite direction. Because of this it is possible to switch the drive motor (118) in such a way that it reverses the tensioning disk (111) by the angular amount of the spacing in the arrangement of the permanent magnets (130, 131), so that then like poles of the permanent magnets (130, 131) lie opposite each other. Such turning back of the tensioning disk (111) can be simply performed, particularly when the drive motor (118) is embodied as a step motor which is turned back by a number of steps corresponding to a division of the arrangement of the permanent magnets (130, 131). If subsequently the drive motor (118) is again turned in the forward direction, the permanent magnets (130, 131) automatically align themselves in such a way that unlike poles lie opposite each other, so that the operational position is automatically assumed again, in which the yarn tensioner is closed.

Figure 8:
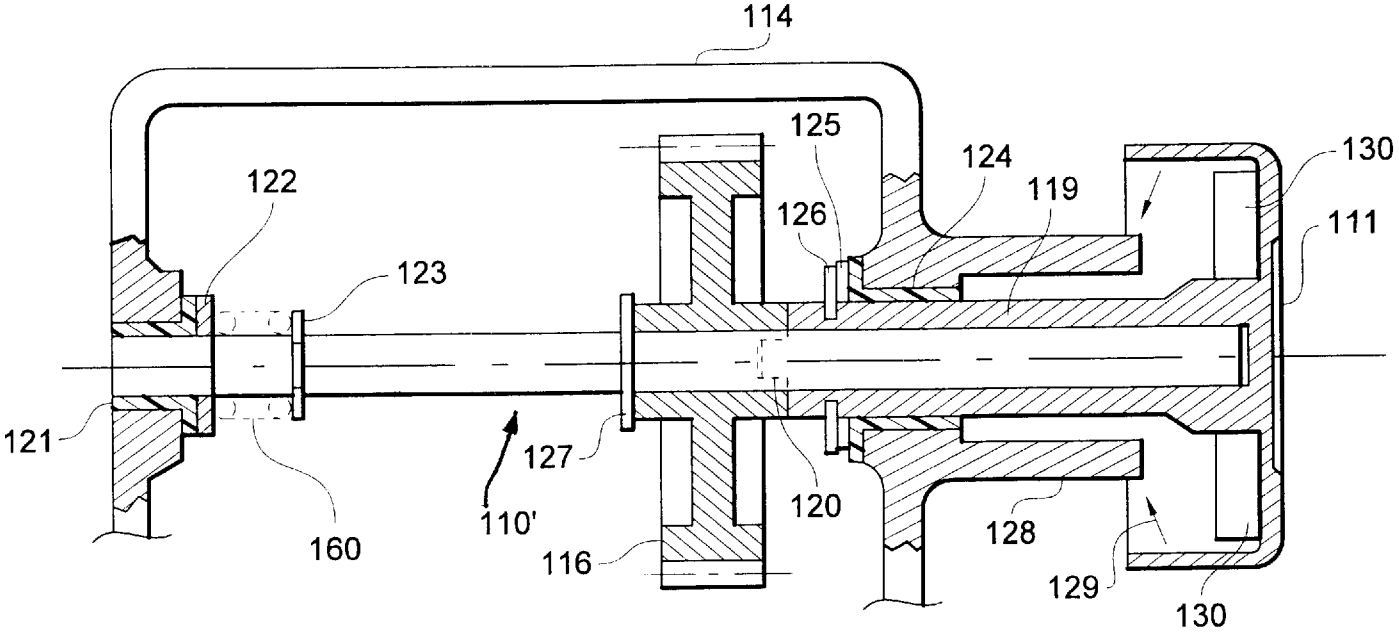
FIG. 8 shows a sectional view through a drive unit of a yarn tensioner with another variant of the present invention.

In the case where it is desired to prevent the reversing of the drive motor, the indirectly driveable tensioning disk (113) can also be prevented from rotating by means of a switchable braking mechanism, so that then the directly driveable tensioning disk (111) with its permanent magnets (130) can be rotated in the forward direction in relation to the tensioning disk (113) and its permanent magnets (131). In this case it is possibly more advantageous to transmit the opening movement to the tensioning disk (111), i.e., that then the tensioning disk (111) moves away from the stationary tensioning disk (113). In this case the retracting movement would be taken over by the drive unit (110') as shown in FIG. 8. In this drive unit (110'), which in its basic structure corresponds to the drive unit (110) of FIG. 7*a*, a compression spring (160) is disposed between the bearing disk (122) and the retaining ring (123), which permits an axial movement of the shaft (115), including all elements seated on it, in order to open the yarn tensioner. The magnetic repulsive forces generated by the permanent magnets (130, 131) are arranged so the they can overcome the deflection resistance of compression spring (160) to thereby permit axial movement of the shaft (115). The movement of the tensioning disk (113) in the direction toward the tensioning disk (111) is limited by means of a stop or the like, so that the tensioning disk (113) does not follow the tensioning disk (111) during opening because of the load-applying devices acting on it.

Further variants are of course possible in respect to the represented and described exemplary embodiment. In particular, it is possible in contrast to the exemplary embodiment to embody the tensioning unit (112) as a combined tensioning and drive unit by providing that the electric motor drive directly drives the holder (137), for example by means of a gear wheel attached to the cylindrical shoulder (136). In this case it would most likely make sense to design the tensioning disk of the other unit in such a way that it performs the opening movement.

It will therefore be readily understood by those persons skilled in the art that the present invention is susceptible of a broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. Apparatus for moving a yarn processing device out of a yarn travel path in a textile machine when a winding process is stopped, comprising:

a yarn processing device having a rotational member engageable with a yarn along a yarn travel path during a winding process;

a drive motor having a forward direction of rotation and a reverse direction of rotation;

a pair of drive members associated with said drive motor;

means operable when said drive motor rotates in said forward direction for driving rotation of said rotational member during the winding process and operable when said drive motor rotates in said reverse direction for effecting relative rotational and axial motion of said drive members when the winding process is stopped; and means for transferring said relative axial motion of said drive members to movement of said rotational member out of possible engagement with the yarn along the yarn travel path.

2. The apparatus of claim 1 and wherein said second drive member moves axially with respect to said drive motor.

3. The apparatus of claim 2 and wherein said first drive member moves axially with respect to said drive motor.

4. A drive assembly for moving a yarn processing device out of a yarn travel path in a textile machine when a winding process is stopped, said assembly comprising:

(a) a drive motor having a forward direction of rotation for when the winding process is occurring and a reverse direction of rotation for when the winding process is stopped;

(b) drive means associated with said drive motor for actuating rotational motion of a rotational member of a yarn processing device engageable with a yarn along a yarn travel path during forward rotation of the drive motor during the winding process;

(c) first and second drive members, said first drive member being arranged to rotate when said drive motor rotates in said reverse direction when the winding process is stopped and said second drive member being arranged to be fixed against rotation with said first drive member when said drive motor rotates in said reverse direction when the winding process is stopped;

(d) means for effecting axial movement of one of said first and second drive members when said first drive member rotates relative to said second drive member when the winding process is stopped; and (e) means for transferring said axial movement of said one drive member into movement of the yarn processing device when the winding process is stopped for moving the rotational member out of possible engagement with the yarn along the yarn travel path.

5. The drive assembly of claim 4, wherein said drive means further comprises and second drive member on each other axially relative to one another, a resilient member for urging said first drive member and second drive member axially together.

6. The drive assembly of claim 5, wherein said means for effecting axial movement comprises cam surfaces disposed on said first drive member and said second drive member.

7. The drive assembly of claim 4, wherein said drive means further comprises a shaft on which said first drive member and second drive member are disposed coaxially, said shaft being arranged for driving said yarn processing device.

8. The drive assembly of claim 7, wherein said yarn processing device comprises a yarn processing element disposed on said shaft for movement in an axial direction by said one drive member.

9. The drive assembly of claim 7, wherein said yarn processing element is axially fixed with respect to said shaft, said shaft being axially displaceable in association with said one drive member.

10. The drive assembly of claim 7, wherein said first and second drive members comprise a screw-drive assembly disposed between said drive motor and said shaft, said shaft being fixed against relative rotation with said yarn processing element and said second drive member, and said drive means further comprises a rotational element connected to said shaft for preventing said shaft from turning in said reverse direction.

11. The drive assembly of claim 4, wherein said drive means further comprises a housing supporting said second drive member against relative rotation with respect to the housing and a free-wheeling device connecting said first drive member with said drive motor, said free-wheeling device being arranged to rotate with respect to said housing in said forward direction without causing said first drive member to rotate with respect to said housing in said forward direction.

12. The drive assembly of claim 4, wherein said drive means further comprises an auxiliary element driven by rotation of said first drive member in said reverse direction.

13. The drive assembly of claim 4, wherein said yarn processing device is a waxing device.

14. The drive assembly of claim 4, wherein said yarn processing device is a yarn tensioning device.

15. The drive assembly of claim 14, wherein said yarn tensioning device includes a pair of tensioning disks arranged in opposed disposition to one another, said drive means further comprising means for directly driving one said tensioning disk from said motor, and magnetic means for indirectly driving the other tensioning disk, said magnetic means comprising a first plurality of permanent magnets arranged in association with said one tensioning disk in a predetermined annular pattern angularly spaced from one another and a second plurality of permanent magnets arranged in association with said other tensioning disk in a corresponding annular pattern, said first and second plurality of magnets being relatively arranged to normally attract one another for unitary driving of said pair of disks, disk separating means for selectively separating said pair of disks, said disk separating means comprising means for selectively preventing rotation of said other tensioning disk and means for rotating said one tensioning disk by an angular amount sufficient to reorient said first and second plurality of magnets to repel one another and thereby separate said disks, and means for yieldably biasing said tensioning disks toward one another.

16. The drive assembly of claim 15, wherein said drive means further comprises a bearing supporting said other tensioning disk against rotation in said reverse direction.

17. The drive assembly of claim 15, wherein said other tensioning disk comprises a holder for supporting said second plurality of magnets and said drive means further comprises means supporting said magnet holder for limited axial movement away from said one tensioning disk.

18. The drive assembly of claim 15, wherein said drive means further comprises a resilient spring member for urging said one tensioning disk into an operating position, said magnets having a predetermined repulsive force and said spring member having a threshold deflection level less than said predetermined repulsive force.

19. The drive assembly according to claim 15, wherein said drive motor comprises an electric stepping motor.

20. Apparatus for moving a yarn processing device with respect to a yarn travel path in a textile machine, comprising:

a drive motor having a forward direction of rotation and a reverse direction of rotation;

a pair of drive members associated with said drive motor;

means operable when said drive motor rotates in said forward direction for effecting relative rest between said drive members and operable when said drive motor rotates in said reverse direction for effecting relative rotational and axial motion of said drive members; and means for transferring said relative axial motion of said drive members to movement of the yarn processing device.

21. A drive assembly for moving a yarn processing device with respect to a yarn travel path in a textile machine, said assembly comprising:

(a) a drive motor having a forward direction of rotation and a reverse direction of rotation; and (b) drive means associated with said drive motor for actuating motion of said yarn processing device with respect to the yarn travel path, said drive means comprising:

(i) first and second drive members, said first drive member being arranged to rotate when said drive motor rotates in said reverse direction and said second drive member being arranged to be fixed against rotation with said first drive member when said drive motor rotates in said reverse direction;

(ii) means for effecting axial movement of one of said first and second drive members when said first drive member rotates relative to said second drive member;

(iii) means for transferring said axial movement of said one drive member to movement of the yarn processing device; and (v) a resilient member for urging axially said first drive member and second drive member together.

22. The device assembly of claim 21, wherein said means for effecting axial movement comprises cam surfaces disposed on said first drive member and said second drive member.

23. A drive assembly for moving a yarn processing device with respect to a yarn travel path in a textile machine, said assembly comprising:

(a) a drive motor having a forward direction of rotation and a reverse direction of rotation; and (b) drive means associated with said drive motor for actuating motion of the yarn processing device with respect to the yarn travel path, said drive means comprising:

(i) first and second drive members, said first drive member being arranged to rotate when said drive motor rotates in said reverse direction and said second drive member being arranged to be fixed against rotation with said first drive member when said drive motor rotates in said reverse direction;

(ii) means for effecting axial movement of one of said first and second drive members when said first drive member rotates relative to said second drive member;

(iii) means for transferring said axial movement of said one drive member to movement of the yarn processing device; and (iv) a housing supporting said second drive member against relative rotation with respect to the housing and a free-wheeling device connecting said first drive member with said drive motor, said free-wheeling device being arranged to rotate in said forward direction relative to said housing without causing said first drive member to rotate in said forward direction relative to said housing.

* * * * *